United States Patent [19]

Johns

[11] 4,323,163

[45] Apr. 6, 1982

[54] ARTICLE DISPLAY UNITS AND MEMBERS FOR FORMING THEM

[76] Inventor: Robert L. Johns, 927 Azalea La., Vero Beach, Fla. 32960

[21] Appl. No.: 129,686

[22] Filed: Mar. 12, 1980

[51] Int. Cl.[3] ..... A47F 7/14; E04C 1/10; E04C 1/30

[52] U.S. Cl. ..... 211/189; 52/588; 52/593

[58] Field of Search ..... 211/183, 189, 87, 94; 52/588, 593, 594, 570, 579; 248/220.3

[56] References Cited

U.S. PATENT DOCUMENTS

| | | | |
|---|---|---|---|
| 3,172,540 | 3/1965 | Berge | 211/87 |
| 3,235,218 | 2/1966 | Graham | 248/220.3 |
| 3,289,375 | 12/1966 | Cline | 52/570 |
| 3,352,428 | 11/1967 | Sak et al. | 211/87 |
| 3,425,568 | 2/1969 | Albright | 211/94 |
| 3,557,511 | 1/1971 | Curran | 52/588 |
| 3,895,720 | 7/1975 | Presberg | 211/126 |
| 3,992,839 | 11/1966 | La Borde | 52/570 |

FOREIGN PATENT DOCUMENTS

| | | | |
|---|---|---|---|
| 454573 | 2/1949 | Canada | 52/593 |
| 791124 | 9/1935 | France | 52/579 |
| 1580113 | 7/1969 | France | 52/594 |

*Primary Examiner*—James L. Ridgill, Jr.
*Attorney, Agent, or Firm*—Carroll F. Palmer

[57] ABSTRACT

Article display units are formed by assembling together a plurality of elongated members to form a panel containing parallel slots in each exterior surface into which article support devices may be hooked. The elongated members comprise a rectangular web, an integral cylindrical element and an integral C-shaped element. The cylindrical element of one member is inserted into the C-shaped element of an adjacent member to lock the members into a panel assembly.

8 Claims, 16 Drawing Figures

FIG 1
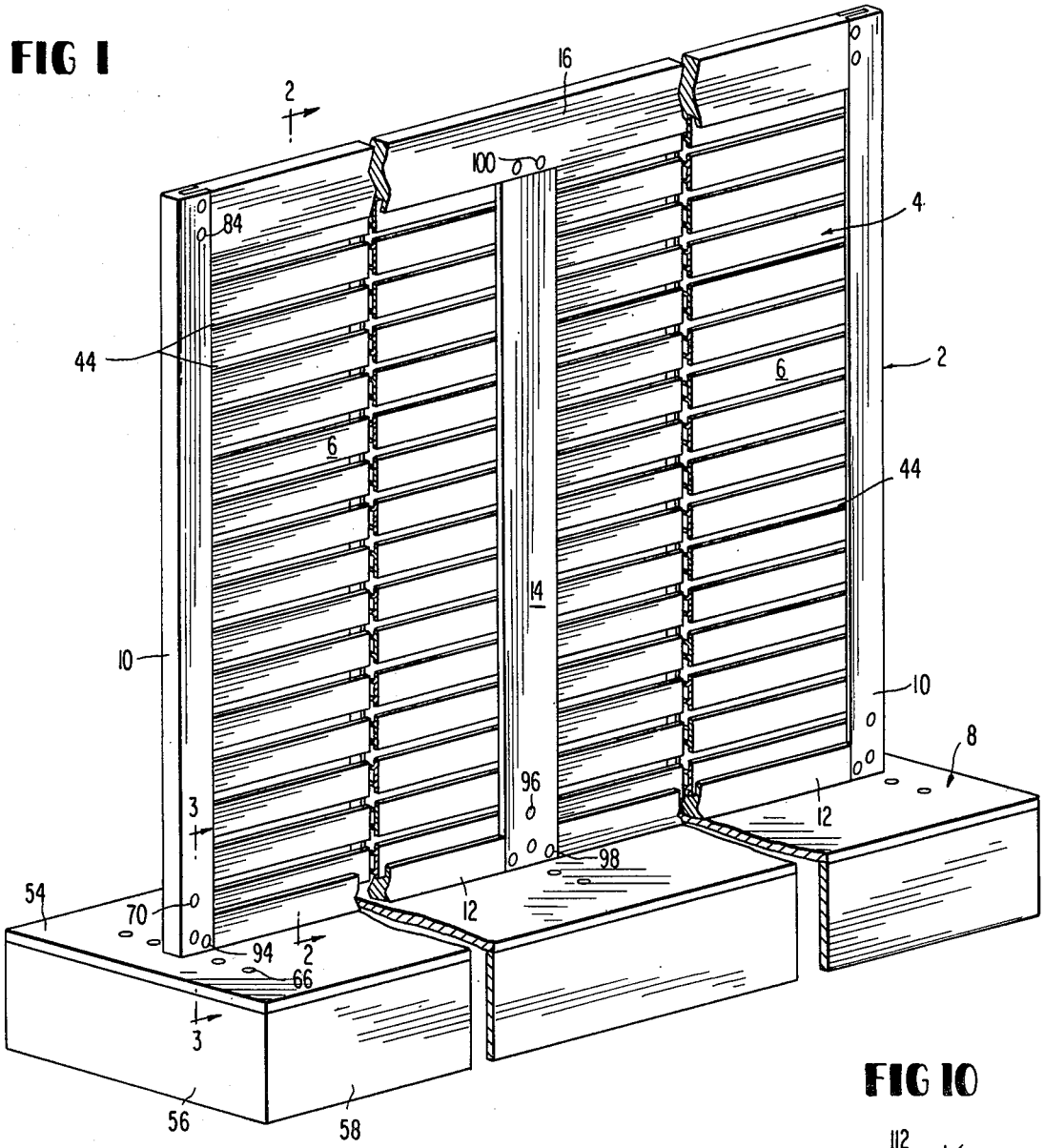
FIG 9
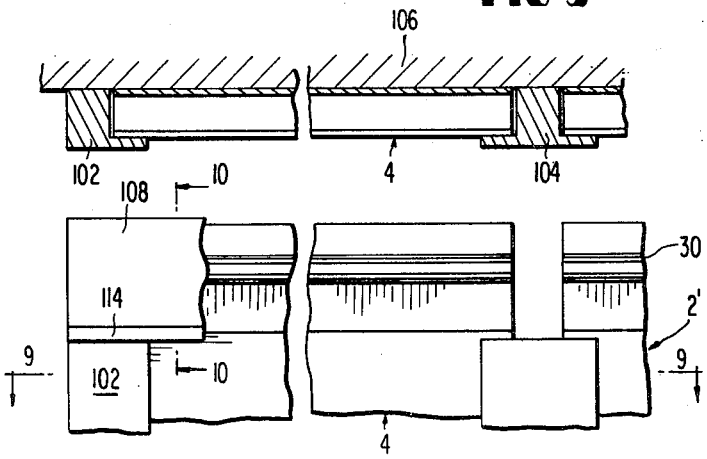
FIG 8
FIG 10
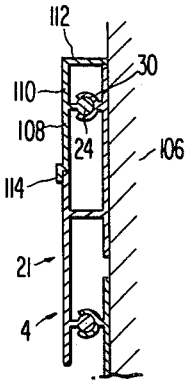

FIG 12
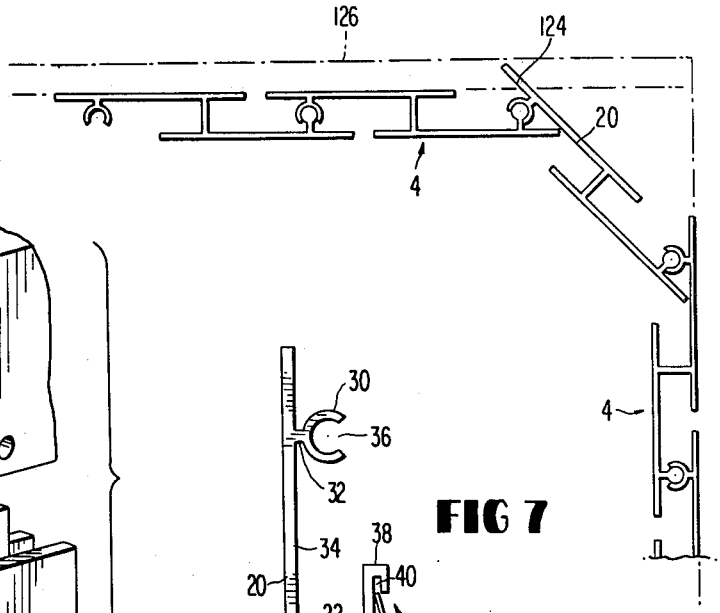
FIG 5
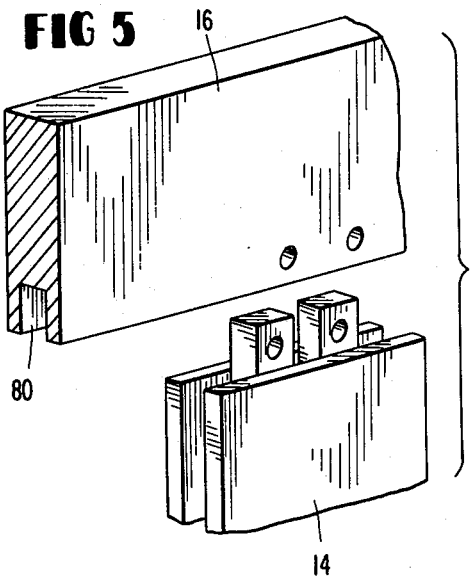
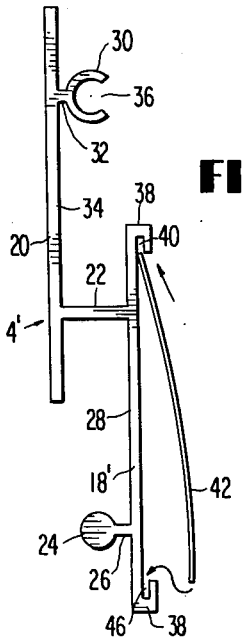
FIG 7
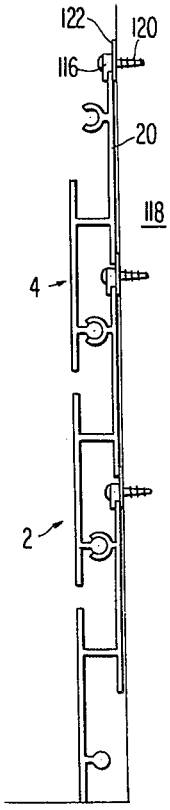
FIG 11
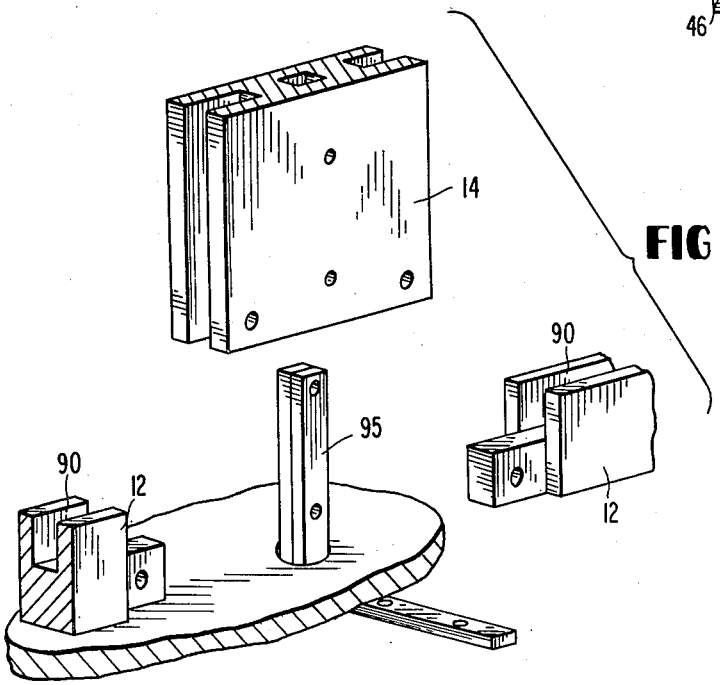
FIG 6

ARTICLE DISPLAY UNITS AND MEMBERS FOR FORMING THEM

BACKGROUND OF THE INVENTION

1. Field of the Invention

This invention broadly relates to article display units. More particularly it concerns interlocking members that may be assembled into slotted panels into which article support devices may be hooked.

2. Description of the Prior Art

Boards or panels upon which articles may be hung or supported for display, storage or other purpose are well known in the art. An example of such items is the so-called "Peg Boards" that have numerous holes therein by which support devices of various configurations may be hooked.

Another basic form of article display units comprise panels that have horizontal slots or channels into which article display devices may be hooked, e.g., see U.S. Pat. No. 3,172,540 and 3,235,218. The present invention provides improved forms of article display units of this general type.

It is also known in the art to form longitudinal members, such as by rolling or extrusion of metal or plastic, that are structured so that various members may be interlocked with one another to produce an assembly for mounting or supporting a wide variety of items, e.g., see U.S. Pat. No. 3,425,568. This basic concept has even been utilized in the production of mounting assemblies that have a series of parallel slots in one or both surfaces of a panel unit, e.g., see U.S. Pat. No. 3,352,428. The present invention utilizes this general concept of assembly construction to provide article display units of improved design.

OBJECTS

A principal object of this invention is the provision of new and improved forms of article display units.

Further objects include the provision of:

1. Unique members that may be interlocked with one another to form an article mounting assembly.

2. Such members that may be assembled into arcuate, as well as flat, panels having a series of parallel slots in both exterior surfaces.

3. New forms of article display units that may be formed of a single basic member and without any lineal size limitation, either horizontal or vertical.

4. Such units that may be formed of metal, plastic or both and in any desired color or finish, including mirrored or metallic finishes.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

The foregoing objects are accomplished in accordance with this invention by forming article display units through the assembly of a plurality of elongated members that interlock with one another to form panels that contain a series of parallel slots in both exterior surfaces into which article support devices may be hooked.

The members that are used in accordance with the invention to create the display units comprise at least one rectangular web, cylindrical element, and an integral C-shaped element. The members are assembled by sliding the cylindrical element of one member into the C-shaped element of another member. Channel members may be fitted over the ends of the assembled panels to hold them in a rigid, free-standing position. Alternatively, the panels may be fixed to a wall, upright or the like.

If desired, the members may have U-shaped grooves along their side edges into which decorative sheets may be inserted.

BRIEF DESCRIPTION OF THE DRAWINGS

A more complete understanding of the invention may be obtained by reference to the accompanying drawings in which:

FIG. 1 is a fragmentary, isometric view of a free-standing article display unit constructed in accordance with the invention.

FIG. 5 is an enlarged, fragmentary, exploded view of the top portion of the median post section of the article display unit of FIG. 1.

FIG. 6 is an enlarged, fragmentary, exploded view of the bottom portion of the median post section of the article display unit of FIG. 1.

FIG. 7 is a lateral view of a basic assembly member for the article display units of the invention.

FIG. 8 is a fragmentary, plan view of an article display unit of the invention secured directly to a wall by means of frame members.

FIG. 9 is a fragmentary, sectional view taken on the line 9—9 of FIG. 8.

FIG. 10 is a fragmentary, sectional view taken on the line 10—10 of FIG. 8.

FIG. 11 is a lateral view of an article display unit of the invention secured in another manner directly to a wall.

FIG. 12 is a lateral view of an article display unit of the invention and illustrates how the units may be assembled in angled or arcuate configurations rather than as flat panels as shown, for example, in FIGS. 1 and 11.

DESCRIPTION OF THE PREFERRED EMBODIMENTS

Figure 2:
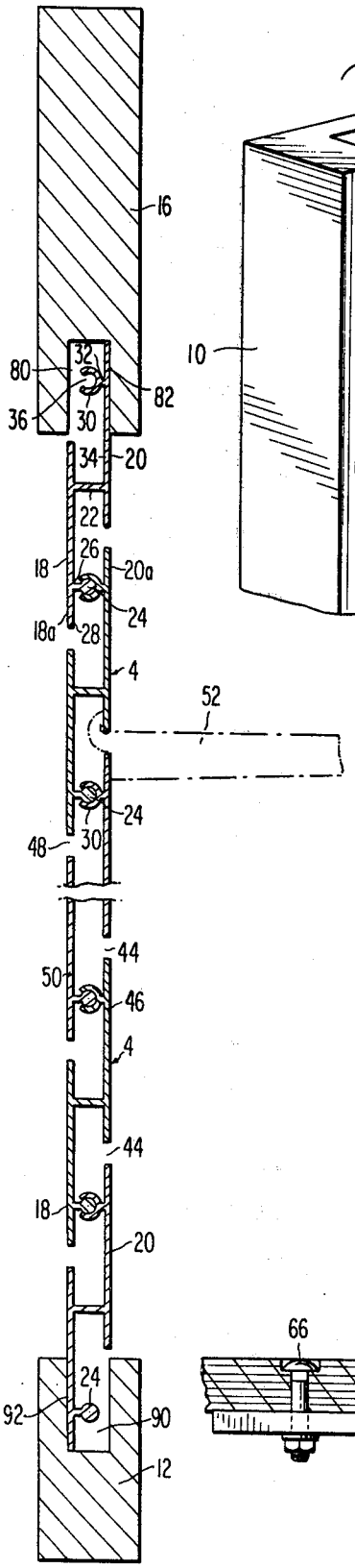
FIG. 2 is a fragmentary, sectional view taken on line 2—2 of FIG. 1.
Figure 4:
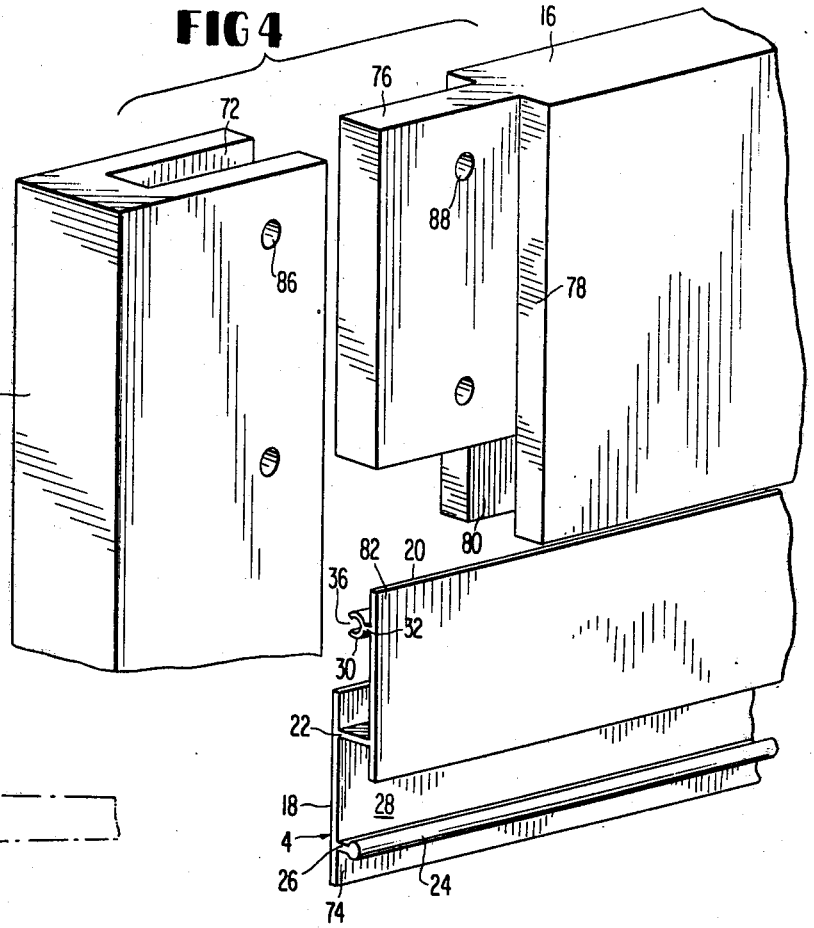
FIG. 4 is an enlarged, fragmentary, exploded view of a top corner of the article display unit of FIG. 1.

Referring in detail to the drawings in which like parts are identically numbered, the article display unit 2 basically comprises a plurality of elongated members 4 assembled to form panels 6, support base 8, side channels 10, bottom channels 12, median channel 14 and top channel 16.

The elongated members 4 comprise a first rectangular web 18 having a length substantially greater than its width and a second rectangular web 20 of size and shape substantially equal to the first web 18. The webs 18 and 20 are spaced apart parallel to each other with only a minor portion 18*a* of the first overlapping an equivalent portion 20*a* of the second. There is a third web 22 integral with and perpendicular to webs 18 and 20 fixing them in the spaced apart, parallel position.

The members 4 further comprise a cylindrical longitudinal elongated element 24 fixed by a short, integral leg 26 to the surface 28 of web 18 that faces web 20 so that element 24 is spaced a short distance from surface 28 with the longitudinal axis of element 25 parallel to web 18.

Members 4 also comprise a longitudinally elongated element 30 of C-shaped cross-section fixed by a short, integral leg 32 to the surface 34 of web 20 that faces web 18 so that element 30 is spaced a short distance apart from web 20 with the longitudinal axis of element 30 parallel to web 20. Advantageously, the spacings of elements 24 and 30 from their respective web 18 and 20 are such that the centers of radius of the elements 24 and 30 are positioned midway between web surfaces 28 and 34.

The diameter of cylindrical elements 24 are greater than the distance across the opening 36 in C-shaped elements 30. Consequently, when an element 24 of one member 4 is inserted from the side into the element 30 of another member 4, the two members 4 are inter-locked. Further, since the openings 36 of elements 30 are larger than the widths of integral legs 26, an assembly of members 4 may assume a flat panel configuration (see FIG. 2) or an angled or arcuate configuration (see FIG. 12).

In the modified form of member 4 shown in FIG. 7, U-shaped side edges 38 are formed integral on web 18 to provide a pair of opposed grooves 40 into which a decorative sheet 42 may be inserted. Alternatively, web 20 may be provided with such side edges and grooves or both webs 18 and 20 may be so constructed.

An article display unit 2 of the invention basically comprises a plurality of the elongated members 4 interlocked through elements 24 and 30 with one another creating a panel 6 containing a plurality of parallel slots 44 on one face 46 and another plurality of parallel slots 48 on the other panel face 50. Article support devices 52 in a variety of forms (only one being illustrated) may be hooked to the panels 6 through the slots 44 and/or 48.

FIG. 1 illustrates a free standing display unit of the invention while FIGS. 8–12 illustrate wall, or similar substrate, mounted display units.

Figure 3:
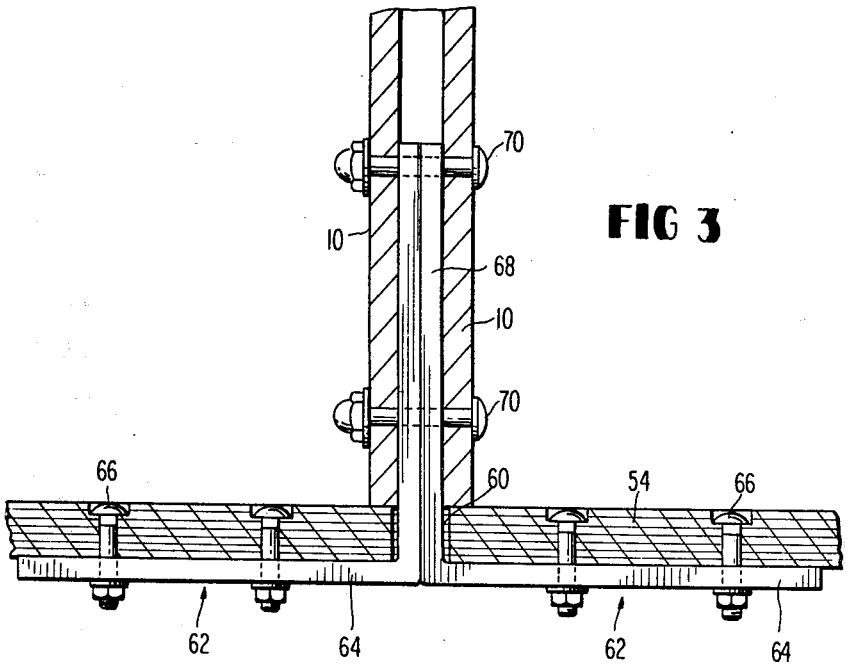
FIG. 3 is an enlarged fragmentary, sectional view taken on the line 3—3 of FIG. 1.
Figure 13:
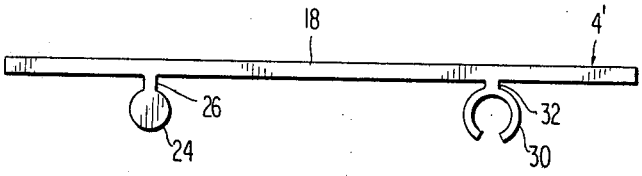
FIG. 13 is a lateral view of another form of basic assembly member of the invention.

In the display unit 2 of FIG. 1, the support base 8 has a top plate 54, end plates 56 and side plates 58 fixed together by fasteners (not shown) or in any other suitable manner. The top plate 54 has a longitudinal slot 60 (see FIG. 3) through which the angles 62 extend. The horizontal legs 64 of angles 62 are fixed by fasteners 66 to the plate 54 and the side channels 10 are fixed to the vertical legs 68 of angles 62 by fasteners 70.

The side channels 10 have a longitudinal groove sized to snugly receive the vertical edges 74 of members 4 and the tongues 76 extending from the the vertical edges 78 of the top channel 16. Likewise, top channel 16 has a longitudinal groove 80 to snugly receive the top edge 82 of top member 4 and the elements 4, 10 and 16 can be fixed in assembled condition by fasteners 84 that extend through mating holes 86 and 88. The bottom channel 12 also has a longitudinal groove 90 to receive lower edge 92 of the member 4 at the bottom of panel 6, the elements 4, 10 and 12 being fixed by fasteners 94 that extend through respective holes in channels 10 and 12.

The median channel 14 is held in upright position on the top plate 54 by angles 95, similarly arranged as angles 62, and fasteners 96. Fasteners 98 fix channels 12 and 14 together at the bottom of panel 6 and fasteners 100 fix channels 14 and 16 together at the top of panel 6. The completed assembly of the parts 4–16 thereby provide a free-standing article display unit 2 into which holder units, e.g., hooks 52, may be inserted in the parallel slots 44 and/or 48.

Advantageously, in the merchandizing of display units as shown in FIG. 1, the base 8 may be used as a package or shipping container for the other parts comprising the display unit. Of course, loose fasteners would be contained in a separate pouch in such a packaging arrangement.

In the wall mounted display unit 2' shown in FIGS. 8–10, the inter-locked members 4 are fixed by the L-shaped strips 102 and T-shaped strips 104 to the wall 106. The strips 102 and 104 may be held on the wall 106 by screws, bolts or the like (not shown).

The top of the display unit 2' is capped with the special elongated member 108 formed by web 110, normal web 112, ledge 114 and the inter-lock element 24.

FIG. 11 illustrates another system for mounting the display unit 2 to a wall or other substrate. The clamps 116 engage the upper edge of the webs 20 of the members 4 and are fixed to the wall 118 by the screws 120. Washers 122 are interposed between the webs 20 and wall 118 to hold the display unit slightly away from the wall to compensate for any irregularities in the wall's surface.

Another system (not shown) for mounting the display units to a wall uses a molded strip to replace the separate clamps 116. Such a strip is fixed to the wall by screws, nails or the like and the assembled unit 2 is then slid into place on the molded strip along the parallel slots between the webs 20 of the members 4.

FIG. 12 illustrates how the members 4 may be installed in an angled or arcuate configuration when this is desired for decoration or other purpose. This flexibility feature enhances the decorative and functional possibilities for the new display units. As shown in FIG. 12, the tip 124 of web 20 prevents the members 4 from being fastened directly to the ceiling 126. If it is desired to mount the upper members 4 directly to the ceiling, the tip 124 may be cut away before applying the members 4 to the ceiling.

The members 4 of the new display units can advantageously be formed by extrusion from metal, e.g., aluminum or other light metal alloys, or from plastics. Other methods of fabrication may also be used, e.g., rolling, molding, etc. The members may be finished in a variety of ways, e.g., painting, anodizing, sheet coating, etc., to suit the requirements of their users.

While the new units 2 have been described above as being assembled and mounted so that the parallel slots 44 are horizontal, it should be apparent that the units may be mounted with the slots 44 vertical or at any desired angle between vertical and horizontal. Also, although the units 2 are primarily for use as article support devices, they can serve, if desired, simply as wall or ceiling coverings. Likewise, they are useful not only in buildings, e.g., stores, homes, etc., but also in vehicles, e.g., vans, boats, etc. and many other places.

As shown in FIGS. 13–16, the basic assembly members 4' may be formed with a single rectangular web 18 to which both the cylindrical longitudinal elongated element 24 and the longitudinal elongated C-shaped element 30 are fixed by integral legs 26 and 32 respectively.

Figure 16:
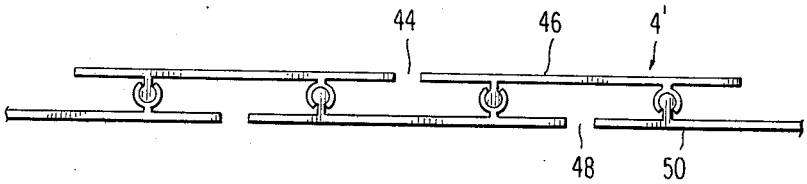
FIG. 16 is a fragmentary view on a reduced scale showing a panel formed by the assembly of a plurality of the members of FIG. 13.

As seen in FIG. 16, a panel having parallel slots 44 on one face 46 and parallel slots 48 on the other face 50 are formed by assembling together a plurality of the members 4'. Such panels may be free-standing or wall mounted and flat or arcuate as described above relative to assembly members 4.

Figure 14:
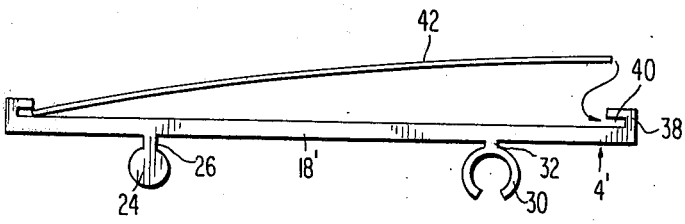
FIG. 14 is a lateral view of a modification of the member shown in FIG. 13.
Figure 15:
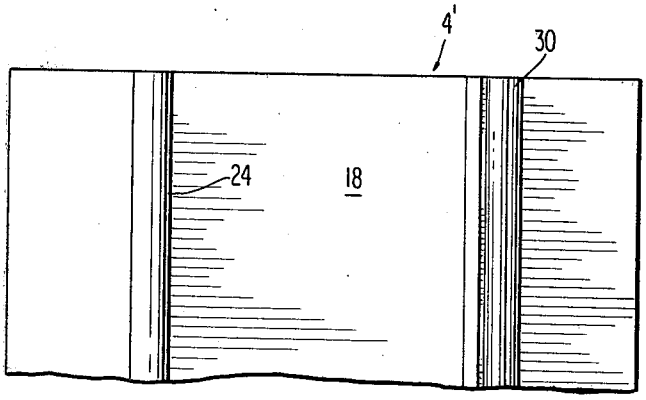
FIG. 15 is a fragmentary posterior view of the member shown in FIG. 13.

In the modified form of member 4' shown in FIG. 14, U-shaped side edges 38 are formed integral on web 18' to provide a pair of opposed grooves 40 into which decorative sheet 42 may be inserted.

The embodiments of the invention in which an exclusive property or privilege is claimed are defined as follows:

1. A member for use in forming an article display panel containing a plurality of parallel slots in an exterior surface thereof by interlocking together a plurality of said members which comprises:

a first rectangular web having a length substantially greater than its width defined by a first pair of longitudinal edges and a first pair of substantially shorter transverse edges, a second rectangular web of size and shape substantially equal to said first rectangular web defined by a second pair of longitudinal edges and a second pair of substantially shorter transverse edges, a longitudinally elongated columnar element fixed to said first web at a position remote from said first longitudinal edges by a short, integral, dependent leg, a longitudinally, elongated tubular element fixed to said second web substantially parallel to said columnar element at a position remote from said second longitudinal edges by a short, integral, dependent leg, a longitudinal slot in said tubular element along the entire length thereof diametrically opposed to said leg thereof, the width of said slot being less than the width of said columnar element, said first and second webs being spaced apart parallel to each other with only a minor portion of said first web overlapping an equivalent portion of said second web, and a third web integral with said first and second webs and perpendicular thereto fixing said first and second webs in said spaced apart parallel position, said columnar element depending from said first web toward said second web, and said tubular element depending from said second web toward said first web, said columnar element and said tubular element being spaced apart from each other a distance such that when a plurality of said members are interlocked into a panel by having columnar elements of said members enveloped by tubular elements of adjacent members, adjacent longitudinal edges of said members are spaced apart forming parallel slots in both exterior surfaces of said panel.

2. The member of claim 1 wherein at least one of said first and second webs have U-shaped longitudinal edges that provide a pair of grooves the openings of which face each other into which a decorative sheet may be inserted.

3. An article display unit comprising a plurality of members as defined in claim 1 fixed together by the sliding of said columnar element of one member into the tubular element of another member thereby creating a panel containing a plurality of parallel slots in an exterior surface of said panel.

4. An article display unit comprising of members as defined in claim 1 fixed together by the sliding of said columnar element of one member into the tubular element of another member thereby creating a panel containing a plurality of parallel slots in both exterior surfaces of said panel.

5. An article display unit of claim 4 that is supported as a free-standing unit by a base into which said panel is inserted.

6. An article display unit of claim 4 having article support devices hooked to said panel through said slots thereof.

7. An article display unit of claim 4 wherein said panel is flat.

8. An article display unit of claim 4 wherein said panel is arcuate.

* * * * *